US005884268A

United States Patent [19]

Campbell et al.

[11] Patent Number: 5,884,268

[45] Date of Patent: Mar. 16, 1999

[54] METHOD AND APPARATUS FOR REDUCING ARTIFACTS THAT RESULT FROM TIME COMPRESSING AND DECOMPRESSING SPEECH

[75] Inventors: William Michael Campbell, Phoenix; Clifford Allan Wood, Tempe, both of Ariz.; James Earl Womack, Bedford, Tex.; Wade Alan Bastien, Euless, Tex.; Deborah Ann Calie, Fort Worth, Tex.; Robert Andrew Rapp, Carrollton, Tex.; Terence Edward Sumner, Azle, Tex.

[73] Assignee: Motorola, Inc., Schaumburg, Ill.

[21] Appl. No.: 883,977

[22] Filed: Jun. 27, 1997

[51] Int. Cl.[6] ..... G10L 3/02

[52] U.S. Cl. ..... 704/278; 704/228; 704/265

[58] Field of Search ..... 704/228–230, 704/258, 265, 500–504, 211, 278, 200, 201

[56] References Cited

U.S. PATENT DOCUMENTS 4,875,038 10/1989 Siwiak et al. .
5,175,769 12/1992 Hejna, Jr. et al. ..... 704/211
5,450,449 9/1995 Kroon ..... 375/350
5,471,470 11/1995 Sharma et al. ..... 370/271
5,689,440 11/1997 Leitch et al. ..... 340/825.44

*Primary Examiner*—David R. Hudspeth
*Assistant Examiner*—Donald L. Storm
*Attorney, Agent, or Firm*—R. Louis Breeden

[57] ABSTRACT

A processing system time compresses a voice message before transmission, and processing system time expands the message after reception. To process the message the processing systems perform at least one of: (a) randomizing the order of a sequence of samples form a silent portion of the message after reception thereof before blending the sequence with a last portion of the expanded message; (b) selecting the sequence of samples from the silent portion of the message after reception thereof, the sequence selected being poorly correlated with the last portion of the expanded message, before blending the sequence with the last portion of the message; and (c) compressing the dynamic range of the message before transmission, by an amount dependent upon the signal-to-noise ratio of the message, and aggressively expanding the dynamic range of the message after reception, by a fixed amount.

13 Claims, 4 Drawing Sheets

200

122

400

METHOD AND APPARATUS FOR REDUCING ARTIFACTS THAT RESULT FROM TIME COMPRESSING AND DECOMPRESSING SPEECH

FIELD OF THE INVENTION

This invention relates in general to voice processing systems, and more specifically to a method and apparatus for reducing artifacts that result from time compressing and decompressing speech.

BACKGROUND OF THE INVENTION

To reduce transmission time, modern voice messaging systems time compress a voice message before transmission and then time decompress, i.e., time expand, the voice message after it is received. Time compression is accomplished by removing redundancy present in the voice message. Time decompression is accomplished by adding redundancy. Removing and adding redundancy is an effective technique for compressing and decompressing voiced speech, which is teeming with redundancy.

Unfortunately, signals that have little or no redundancy, e.g., unvoiced speech and system noise, can cause undesirable artifacts in the decompressed voice message. Adding redundancy to unvoiced speech and noise can cause "warbling" sounds that are audible upon message playback.

Thus, what is needed is a method and apparatus that can minimize the undesirable artifacts produced by the time compression and decompression process when processing unvoiced speech and noise. Preferably the method and apparatus will not require a significant increase in processing power in the device receiving the voice message.

SUMMARY OF THE INVENTION

An aspect of the present invention is a method for reducing artifacts occurring in a voice message in a voice messaging system utilizing time compression and decompression techniques. The method comprises the steps of time compressing the voice message before transmission, and time expanding the voice message after reception. The method further comprises applying a technique during processing of the voice message for reducing the artifacts. The technique is selected from a group of techniques consisting of: (a) randomizing the order of a sequence of samples generated from a silent portion of the voice message after reception thereof before blending the sequence with a last portion of the voice message after time expanding the last portion; (b) selecting the sequence of samples generated from the silent portion of the voice message after reception thereof, the sequence selected being poorly correlated with the last portion of the voice message after time expansion, before blending the sequence with the last portion of the voice message; and (c) compressing the dynamic range of the voice message before transmission, by an amount dependent upon the signal-to-noise ratio measured for the voice message, and aggressively expanding the dynamic range of the voice message after reception, by a fixed amount.

Another aspect of the present invention is a portable subscriber unit for reducing artifacts occurring in a voice message in a voice messaging system utilizing time compression and decompression techniques. The portable subscriber unit comprises a receiver for receiving the voice message, and a processing system coupled to the receiver for processing the voice message. The portable subscriber unit further comprises a speaker coupled to the processing system for outputting the voice message. The processing system is programmed to time expand the voice message after reception, and to apply a technique during processing of the voice message for reducing the artifacts. The technique is selected from a group of techniques consisting of (a) randomizing the order of a sequence of samples generated from a silent portion of the voice message after reception thereof before blending the sequence with a last portion of the voice message after time expanding the last portion; (b) selecting the sequence of samples generated from the silent portion of the voice message after reception thereof, the sequence selected being poorly correlated with the last portion of the voice message after time expansion, before blending the sequence with the last portion of the voice message; and (c) aggressively expanding the dynamic range of the voice message after reception, by a fixed amount.

Another aspect of the present invention is a controller for reducing artifacts occurring in a voice message in a voice messaging system utilizing time compression and decompression techniques. The controller comprises a network interface for receiving the voice message, and a processing system coupled to the network interface for processing the voice message. The controller further comprises an output interface coupled to the processing system for outputting the voice message. The processing system is programmed to time compress the voice message before transmission; and to compress the dynamic range of the voice message before transmission, by an amount dependent upon the signal-to-noise ratio measured for the voice message.

DETAILED DESCRIPTION OF THE DRAWINGS

Figure 1:
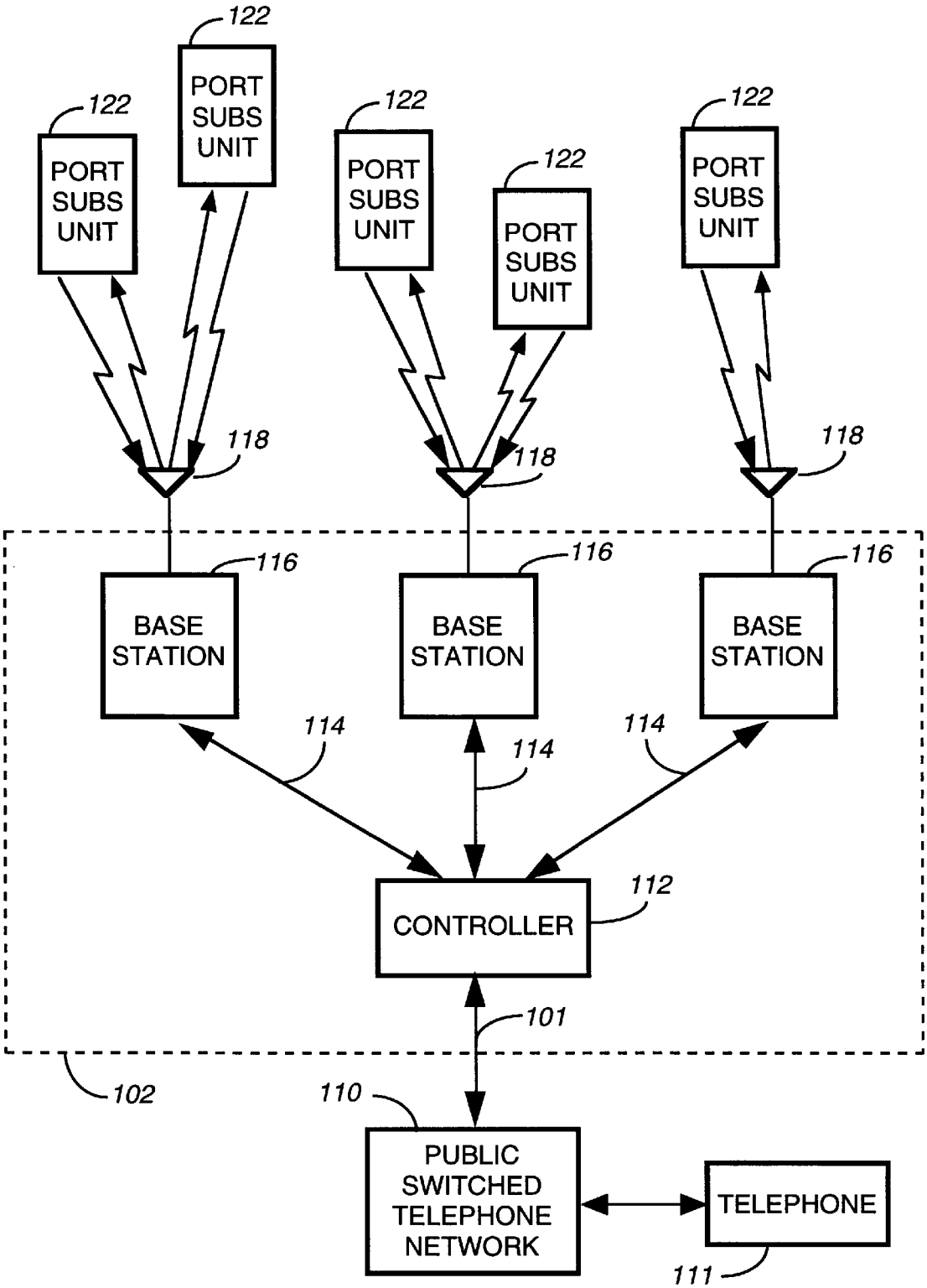
FIG. 1 is an electrical block diagram of a voice messaging system in accordance with the present invention.

Referring to FIG. 1, an electrical block diagram of a voice messaging system in accordance with the present invention comprises a fixed portion 102 including a controller 112 and a plurality of base stations 116, and a portable portion including a plurality of portable subscriber units 122, preferably having acknowledge-back capability. The base stations 116 are used for communicating with the portable subscriber units 122 utilizing conventional radio frequency (RF) techniques, and are coupled by communication links 114 to the controller 112, which controls the base stations 116.

The hardware of the controller 112 is preferably a combination of the Wireless Messaging Gateway (WMG™) Administrator! paging terminal, and the RF-Conductor!™ message distributor manufactured by Motorola, Inc. The hardware of the base stations 116 is preferably a combination of the Nucleus® Orchestra! transmitter and RF-Audience!™ receivers manufactured by Motorola, Inc. The hardware of the portable subscriber units 122 is preferably similar to that of the Tenor™ voice messaging unit also manufactured by Motorola, Inc. It will be appreciated that other similar hardware can be utilized as well for the controller 112, the base stations 116, and the portable subscriber units 122.

Each of the base stations 116 transmits RF signals to the portable subscriber units 122 via a transceiver antenna 118. The base stations 116 each receive RF signals from the plurality of portable subscriber units 122 via the transceiver antenna 118. The RF signals transmitted by the base stations 116 to the portable subscriber units 122 (outbound messages) comprise selective call addresses identifying the portable subscriber units 122, and voice messages originated by a caller, as well as commands originated by the controller 112 for adjusting operating parameters of the radio communication system. The RF signals transmitted by the portable subscriber units 122 to the base stations 116 (inbound messages) comprise responses that include scheduled messages, such as positive acknowledgments (ACKs) and negative acknowledgments (NAKs), and unscheduled messages, such as registration requests. An embodiment of an acknowledge-back messaging system is described in U.S. Pat. No. 4,875,038 issued Oct. 17, 1989 to Siwiak et al., which is hereby incorporated herein by reference. It will be appreciated that, alternatively, the present invention can be applied to a one-way voice messaging system as well.

The controller 112 preferably is coupled by telephone links 101 to a public switched telephone network (PSTN) 110 for receiving selective call message originations therefrom. Selective call originations comprising voice messages from the PSTN 110 can be generated, for example, from a conventional telephone 111 coupled to the PSTN 110. It will be appreciated that, alternatively, other types of communication networks, e.g., packet switched networks and local area networks, can be utilized as well for transporting originated messages to the controller 112.

The protocol utilized for outbound and inbound messages is preferably selected from Motorola's well-known FLEX™ family of digital selective call signaling protocols. These protocols utilize well-known error detection and error correction techniques and are therefore tolerant to bit errors occurring during transmission, provided that the bit errors are not too numerous in any one code word. It will be appreciated that other suitable protocols can be used as well.

Figure 2:
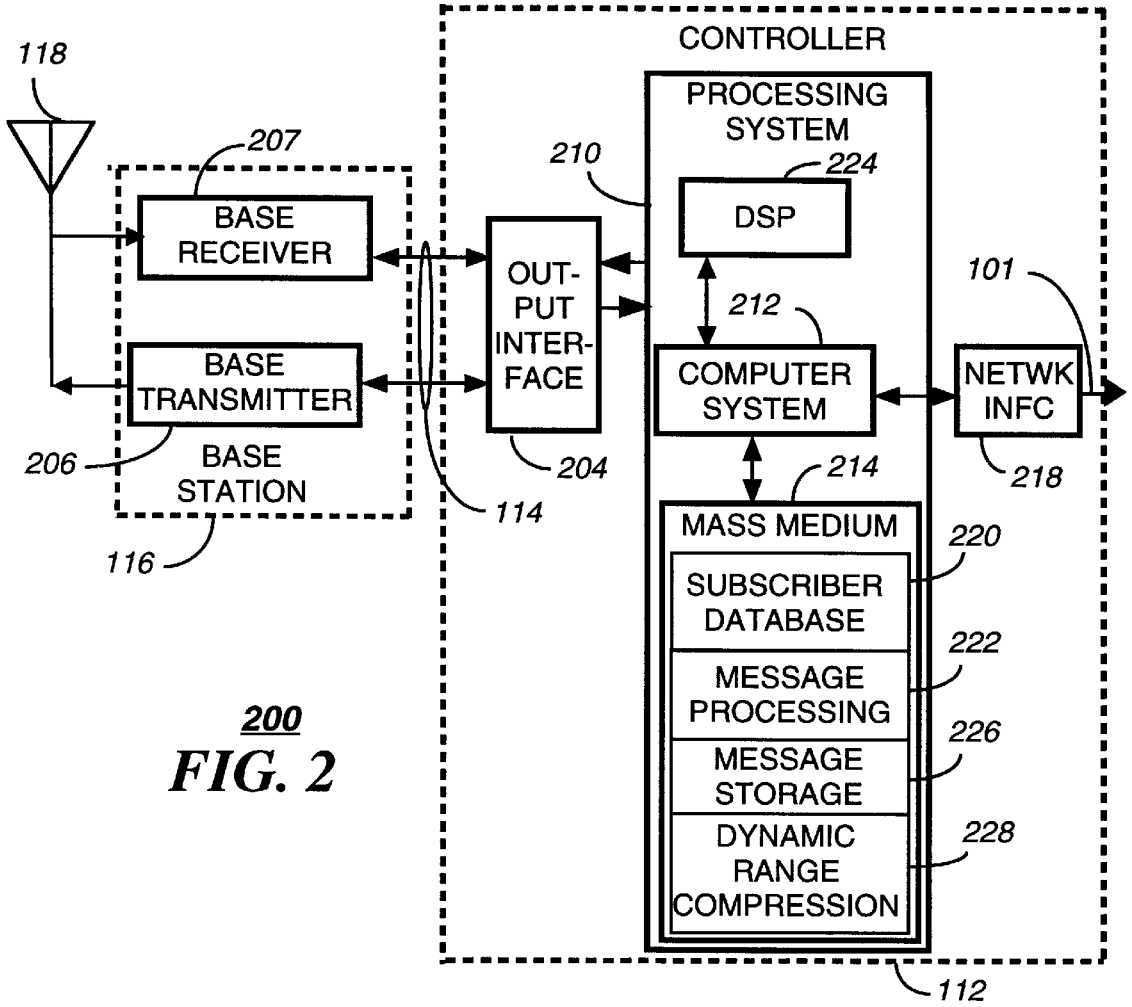
FIG. 2 is an electrical block diagram of portions of a controller and base station in accordance with the present invention.

FIG. 2 is a simplified electrical block diagram 200 of portions of the controller 112 and the base station 116 in accordance with the present invention. The controller 112 includes a processing system 210, a conventional output interface 204, and a conventional network interface 218. The base station 116 includes a base transmitter 206 and (optionally) at least one base receiver 207. At least a portion of the processing performed on the voice messages preferably is implemented in at least one digital signal processor (DSP) 224 executing software readily written by one of ordinary skill in the art, given the teachings of the instant disclosure. Alternatively, the voice processing may be implemented all or in part as one or more integrated circuits. In particular, the preferred embodiment uses a model TMS320C31 DSP manufactured by Texas Instruments, Inc. It will be appreciated that, alternatively, other similar DSPs can be utilized as well for the DSP 224.

The processing system 210 is used for directing operations of the controller 112. The processing system 210 preferably is coupled through the output interface 204 to the base transmitter 206 via the communication link 114. The processing system 210 preferably also is coupled through the output interface 204 to the base receiver 207 via the communication link 114. The communication link 114 utilizes, for example, conventional means such as a direct wire line (telephone) link, a data communication link, or any number of radio frequency links, such as a radio frequency (RF) transceiver link, a microwave transceiver link, or a satellite link, just to mention a few. The processing system 210 is also coupled to the network interface 218 for accepting outbound voice messages originated by callers communicating via the PSTN 110 through the telephone links 101.

In order to perform the functions necessary for controlling operations of the controller 112 and the base stations 116, the processing system 210 preferably includes a conventional computer system 212, and a conventional mass storage medium 214. The conventional mass storage medium 214 includes, for example, a subscriber database 220, comprising subscriber user information such as addressing and programming options of the portable subscriber units 122.

The conventional computer system 212 is preferably programmed by way of software included in the conventional mass storage medium 214 for performing the operations and features required in accordance with the present invention. The conventional computer system 212 preferably comprises a plurality of processors such as VME Sparc™ processors manufactured by Sun Microsystems, Inc. These processors include memory such as dynamic random access memory (DRAM), which serves as a temporary memory storage device for program execution, and scratch pad processing such as, for example, storing and queuing messages originated by callers using the PSTN 110, processing acknowledgments received from the portable subscriber units 122, and protocol processing of messages destined for the portable subscriber units 122. The conventional mass storage medium 214 is preferably a conventional hard disk mass storage device.

It will be appreciated that other types of conventional computer systems 212 can be utilized, and that additional computer systems 212, DSPs 224 and mass storage media 214 of the same or alternative type can be added as required to handle the processing requirements of the processing system 210. It will be further appreciated that additional base receivers 207 either remote from or collocated with the base transmitter 206 can be utilized to achieve a desired inbound sensitivity, and that additional, separate antennas 118 can be utilized for the base transmitter 206 and the base receivers 207.

The mass medium 214 preferably includes software and various databases utilized in accordance with the present invention. In particular, the mass medium 214 includes a message processing element 222 which programs the processing system 210 to perform in accordance with the present invention, as will be described further below. In addition, the mass medium 214 includes a message storage area 226 for storing digitized voice messages. In accordance with the present invention, the mass medium 214 preferably also includes a dynamic range compression element 228 for programming the processing system 210 to compress the dynamic range of a voice message before transmission, by an amount dependent upon the signal-to-noise ratio measured for the voice message. It will be appreciated that the controller 112 and the base station 116 can be either collocated or remote from one another, depending upon system size and architecture. It will be further appreciated that in large systems functional elements of the controller 112 can be distributed among a plurality of networked controllers.

Figure 3:
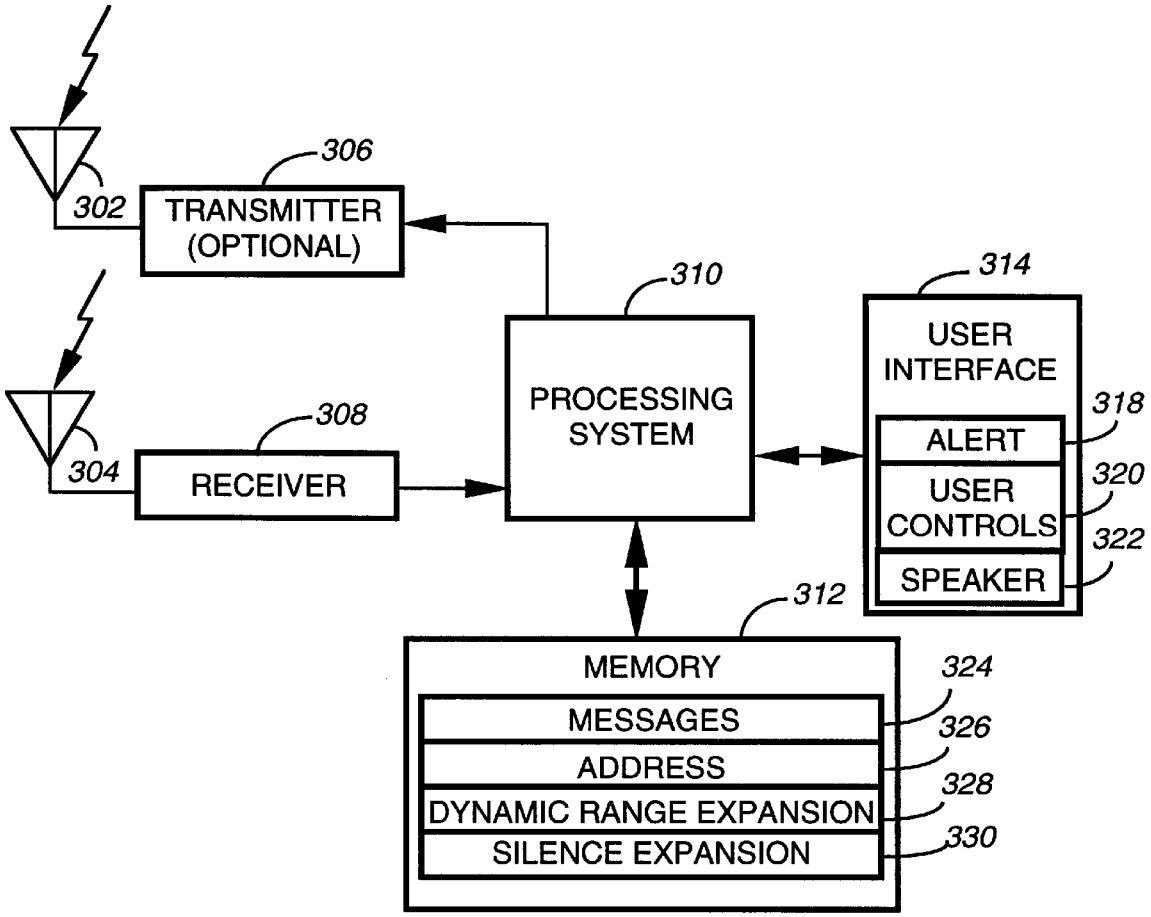
FIG. 3 is an electrical block diagram of a portable subscriber unit in accordance with the present invention.

FIG. 3 is an electrical block diagram of the portable subscriber unit 122 in accordance with the present invention. The portable subscriber unit 122 comprises an antenna 304 coupled to a receiver 308 for receiving the voice message from the base station 116. The receiver 308 is coupled to a processing system 310 for processing the voice message in accordance with the present invention. The processing system 310 preferably includes a conventional DSP, executing software readily written by one of ordinary skill in the art, given the teachings of the instant disclosure. A suitable DSP is the DSP1615 manufactured by Lucent Technologies. The processing system 310 is preferably coupled to a transmitter 306 and antenna 302 for acknowledging messages. It will be appreciated that, alternatively, the transmitter 306 and antenna 302 can be omitted, in a one-way system application. The processing system 310 is also coupled to a memory 312 for storing messages 324, a selective call address 326 assigned to the portable subscriber unit 122, and software elements for programming the processing system according to the present invention. It will be appreciated that the memory 312 can include a mix of random access memory (RAM), read-only memory (ROM), and electrically erasable programmable read-only memory (EEPROM), as appropriate for fulfilling the memory requirements. It will be further appreciated that, alternatively, the memory 312 can be included as an integral portion of the processing system 310, as well.

The software elements in the memory 312 preferably include a dynamic range expansion element 328 for expanding the dynamic range of the voice message by a fixed amount equal to the largest amount of compression of the dynamic range allowable for transmission, i.e., the amount applied to voice messages having a signal-to-noise ratio above a highest predetermined level. Alternatively, the software elements can include a silence expansion element 330. The silence expansion element 330 is for programming the processing system 310 in accordance with first and second alternative embodiments of the present invention. In the first alternative embodiment the silence expansion element 330 programs the processing system 310 to randomize the order of a sequence of samples generated from a silent portion of the voice message after reception of the voice message. The silence expansion element 330 further programs the processing system 310 to then blend the sequence with a last portion of the voice message after time expanding the last portion of the voice message. In the second alternative embodiment the silence expansion element 330 programs the processing system 310 to select the sequence of samples generated from the silent portion of the voice message after reception of the voice message. The sequence selected is one that is poorly correlated with the last portion of the voice message after time expansion, before blending the sequence with the last portion of the voice message. The effect of both the first and second alternative embodiments is to prevent the silent portions of the message from becoming highly correlated with the preceding expanded word, thereby advantageously reducing the undesirable artifacts that can occur when the silent portions are decompressed using prior art techniques.

The processing system 310 is also coupled to a user interface 314, comprising a conventional audible, tactile, or visible alert device 318 for alerting the user when a message is received. The user interface 314 also includes conventional user controls 320 for enabling control of the portable subscriber unit 122 by the user, and a conventional speaker 322 for reproducing the voice message.

Figure 4:
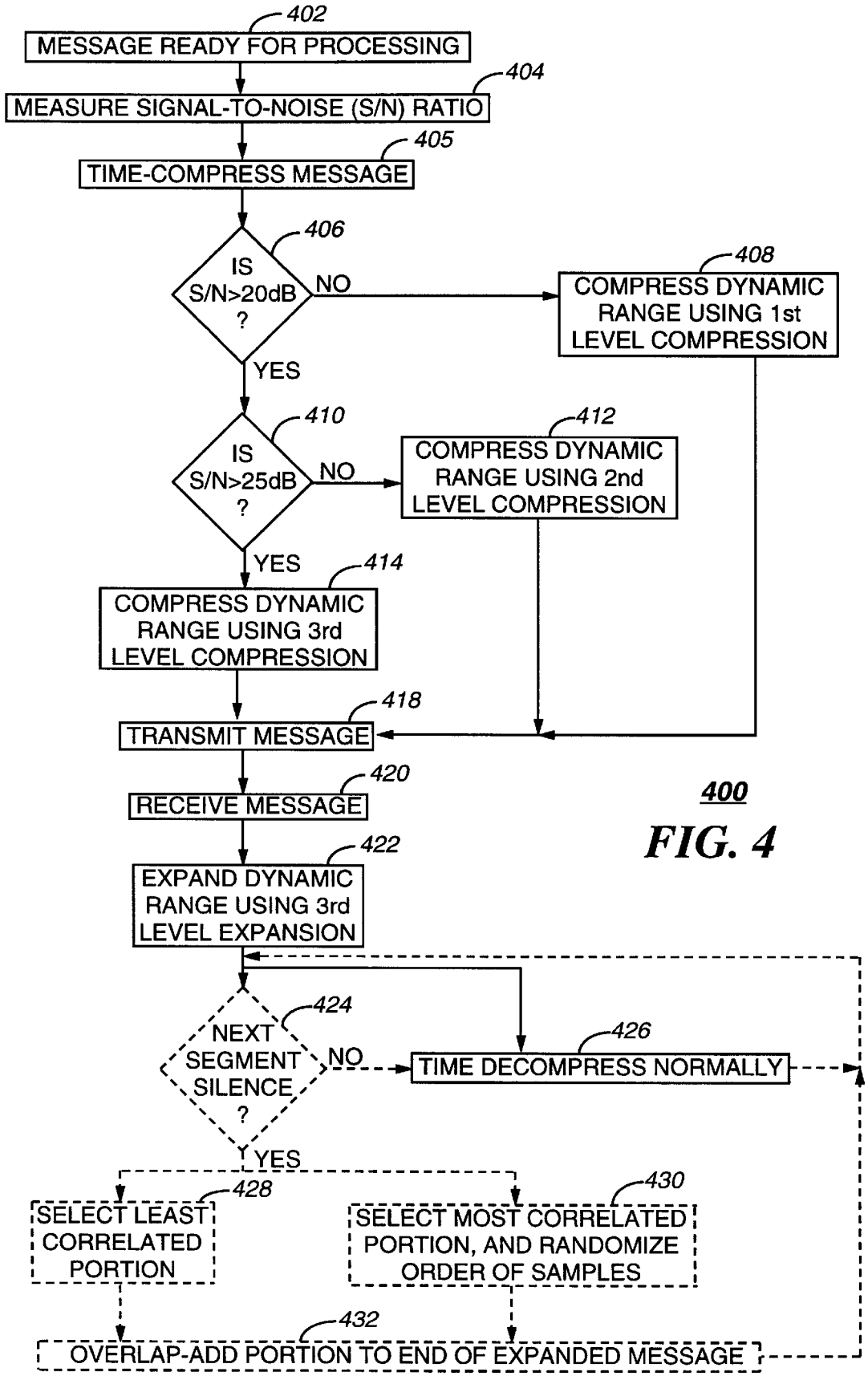
FIG. 4 is a flow chart depicting operation of the voice messaging system in accordance with the present invention.

FIG. 4 is a flow chart 400 depicting operation of the voice messaging system as programmed in accordance with the present invention. The flow begins at step 402 when the processing system 210 of the controller 112 receives a message to be processed. The processing system 210 then measures 404 the signal-to-noise ratio (S/N) of the message, using well-known techniques. The processing system 210 then time compresses 405 the voice message, preferably by applying an overlap-add technique, as disclosed in application Ser. No. 08/764,656, now U.S. Pat. No. 5,689,440 filed Dec. 11, 1996 by Leitch et al., entitled "Voice Compression Method and Apparatus in a Communication System." Said application is hereby incorporated herein by reference. It will be appreciated that, alternatively, other, well-known time compression techniques can be applied instead to time compress the voice message. The processing system 210 then checks at step 406 whether the S/N is greater than 20 dB. If not, the processing system 210 compresses 408 the dynamic range of the message, using a first predetermined level of compression. The dynamic range compression preferably is performed by calculating the absolute values of the samples of the voice message, applying a windowed running average to the absolute values to develop envelope values representing a smoothed envelope of the speech, and dividing the amplitudes of the samples by corresponding ones of the envelope values raised to a power. In the case of the first predetermined level of compression, the power to which the envelope values are raised is preferably 0.5.

If, on the other hand, at step 406 the processing system 210 finds that the S/N is greater than 20 dB, then the processing system 210 checks at step 410 whether the S/N is greater than 25 dB. If not, the processing system 210 compresses 412 the dynamic range of the voice message, using a second, higher level of compression, i.e., the power to which the envelope values are raised is preferably 0.57. If at step 410 the processing system 210 finds that the S/N is greater than 25 dB, then the processing system 210 compresses 414 the dynamic range of the voice message, using a third, still higher level of compression, i.e., the power to which the envelope values are raised is preferably 0.65. It will be appreciated that, alternatively, other levels and methods of dynamic range compression somewhat different from the preferred levels and method can be used as well without departing from the scope and intent of the present invention. It will be further appreciated that the dynamic range compression and the time compression can be performed in any order; i.e., the message can be time compressed before the dynamic range is compressed, as described above, or the time compression can be performed after the dynamic range compression. Doing the time compression first, provides the advantage of a lower processing requirement for performing the dynamic range compression, because there are then fewer samples for which to compress the dynamic range. After compressing the dynamic range of the message, the processing system 210 preferably then controls the base transmitter 206 to transmit 418 the message. At the portable subscriber unit 122, the receiver 308 receives 420 the compressed voice message and then the processing system 310 of the portable subscriber unit 122 expands 422 the dynamic range by a fixed amount that corresponds to the largest amount of dynamic range compression allowable for transmission. In other words, a dynamic range expansion sufficient to restore the original dynamic range of the voice message when the third level of compression (power of 0.65) has been applied is used by the processing system 310. The dynamic range expansion is similar to the dynamic range compression in that the processing system 310 calculates the absolute values of the samples of the compressed voice message and applies a windowed running average to the absolute values to develop envelope values representing a smoothed envelope of the speech. A difference here is that the processing system 310 then multiplies the amplitudes of the samples of the voice message by corresponding ones of the envelope values raised preferably to a power of two to decompress (expand)

the dynamic range. This amount of dynamic range expansion, is substantially higher than has been employed in prior art messaging systems and has advantageously and unexpectedly been found to produce a significant reduction in the undesirable artifacts during silence and unvoiced speech. For the purposes of this application, dynamic range expansion in which the amplitudes of the samples of the voice message are multiplied by corresponding ones of the envelope values raised to approximately a power of two (or higher) is defined to be "aggressive" expansion. In the preferred embodiment, the processing system 310 then time decompresses 426 the voice message, preferably by applying an overlap-add time expansion technique similar to that used to time compress the voice message, as also explained in U.S. application Ser. No. 08/764,656, now U.S. Pat. No. 5,689,440, earlier incorporated herein by reference.

In the first alternative embodiment, additional processing is applied to segments of the voice message that are determined by the portable subscriber unit 122 to be periods of silence, e.g., system noise between words. The additional processing includes determining 424 whether a segment of the voice message represents silence. Segments of silence are preferably detected in a manner similar to that disclosed in U.S. patent application Ser. No. 08/871,795, by Papa et al., mailed Jun. 9, 1997, entitled "Method and Apparatus for Processing Frames of Speech Samples and Frames of Silence Samples." It will be appreciated that, alternatively, other, well-known methods of silence detection can be utilized as well to locate the segments of silence. If the segment is not silence, the processing system 310 time decompresses 426 the segment normally. If the segment is silence, however, the processing system 310 finds the best correlated portion of the segment, as is usually done in the overlap-add technique, and then randomizes 430 the order of the samples of the best correlated portion, e.g., by moving the first sample to the fifth position, the second sample to the fifteenth position, the third sample to the first position, and so on, preferably according to a predetermined pseudorandom sequence. It will be appreciated that many other randomization techniques can be utilized as well for randomizing the order of the samples. The reason for randomizing the best correlated portion is to ensure that the portion to be overlap-added is not correlated with a last time-expanded portion of the voice message, to which the randomized portion will be overlap-added, thereby reducing the artifacts that can be generated when the portion to be overlap-added is correlated. The processing system 310 then overlap-adds 432 the randomized portion to the end of the expanded message formed thus far. The flow then returns to step 424 to process the next segment of the message (until the entire message has been processed).

In the second alternative embodiment the processing of silent segments is similar to that of the first alternative embodiment. The essential difference is that instead of selecting the most correlated portion and then randomizing the order of its samples, the second alternative embodiment simply selects a portion that is the least correlated with the last time-expanded portion of the voice message. Alternatively, the second alternative embodiment can select a portion that exhibits a correlation with the last time-expanded portion of the voice message, the correlation being less than a predetermined amount. While both the first and second alternative embodiments function well to minimize the undesirable artifacts, both require considerably more processing power and memory than are required for the preferred embodiment. That is why the preferred embodiment is preferred, especially for battery powered portable equipment. It will be appreciated that the techniques of the present invention can also be applied entirely within the controller 112 for reducing undesirable artifacts during playback of stored messages for people who wish to listen by telephone to their stored messages. To save space on the mass storage medium 214, the processing system 210 stores messages on the mass storage medium 214 in time compressed format. Thus, a message again must be time decompressed during playback. The present invention preferably is utilized in the storage and playback process to reduce the undesirable artifacts that would otherwise be present.

Thus, it should be apparent from the foregoing disclosure that the present invention provides a method and apparatus that minimizes the undesirable artifacts produced by the time compression and decompression process when processing unvoiced speech and noise. Advantageously, the preferred embodiment of the present invention does not require a significant increase in processing power in the device receiving the voice message.

Many modifications and variations of the present invention are possible in light of the above teachings. For example, the first or second alternative embodiment can be practiced without the preferred embodiment, as well as in combination with the preferred embodiment as depicted in the flow chart 400. In addition, the processing system 310, alternatively, can time decompress the message before expanding the dynamic range instead of after. Thus, it is to be understood that, within the scope of the appended claims, the invention may be practiced other than as described herein above.

What is claimed is:

1. A method for reducing artifacts occurring in a voice message in a voice messaging system utilizing time compression and decompression techniques, the method comprising the steps of:

time compressing the voice message before transmission;

time expanding the voice message after reception; and applying a technique during processing of the voice message for reducing the artifacts, the technique selected from a group of techniques consisting of:

(a) randomizing an order of a sequence of samples generated from a silent portion of the voice message after reception thereof before blending the sequence with a last portion of the voice message after time expanding the last portion;

(b) selecting the sequence of samples generated from the silent portion of the voice message after reception thereof, the sequence selected being poorly correlated with the last portion of the voice message after time expansion, before blending the sequence with the last portion of the voice message; and (c) compressing dynamic range of the voice message before transmission, by an amount dependent upon a signal-to-noise ratio measured for the voice message, and aggressively expanding the dynamic range of the voice message after reception, by a fixed amount.

2. The method of claim 1, wherein the technique (a) comprises the steps of:

locating the silent portion;

determining a segment of the silent portion that best correlates with a last time-expanded portion of the voice message; and randomizing the order of the sequence of samples that forms the segment.

3. The method of claim 1, wherein the technique (b) comprises the steps of:

locating the silent portion; and determining a segment of the silent portion that least correlates with a last time-expanded portion of the voice message.

4. The method of claim 1, wherein the technique (b) comprises the steps of:

locating the silent portion; and determining a segment of the silent portion that exhibits a correlation with a last time-expanded portion of the voice message, the correlation being less than a predetermined amount.

5. The method of claim 1, wherein the technique (c) comprises the step of:

compressing the dynamic range of the voice message before transmission by an amount which increases as signal-to-noise ratio increases.

6. The method of claim 1, wherein the technique (c) comprises the step of:

expanding the dynamic range of the voice message after reception by an amount equal to a largest amount of compression of the dynamic range allowable for transmission.

7. The method of claim 1, wherein the step of time compressing the voice message comprises the step of applying an overlap-add speech compression technique, and wherein the step of time expanding the voice message comprises the step of applying an overlap-add speech expansion technique.

8. A portable subscriber unit for reducing artifacts occurring in a voice message in a voice messaging system utilizing time compression and decompression techniques, the portable subscriber unit comprising:

a receiver for receiving the voice message;

a processing system coupled to the receiver for processing the voice message; and a speaker coupled to the processing system for outputting the voice message, wherein the processing system is programmed to:

time expand the voice message after reception; and apply a technique during processing of the voice message for reducing the artifacts, the technique selected from a group of techniques consisting of:

(a) randomizing an order of a sequence of samples generated from a silent portion of the voice message after reception thereof before blending the sequence with a last portion of the voice message after time expanding the last portion;

(b) selecting the sequence of samples generated from the silent portion of the voice message after reception thereof, the sequence selected being poorly correlated with the last portion of the voice message after time expansion, before blending the sequence with the last portion of the voice message; and (c) aggressively expanding dynamic range of the voice message after reception, by a fixed amount.

9. The portable subscriber unit of claim 8, wherein in order to perform the technique (a) the processing system is further programmed to:

locate the silent portion;

determine a segment of the silent portion that best correlates with a last time-expanded portion of the voice message; and randomize the order of the sequence of samples that forms the segment.

10. The portable subscriber unit of claim 8, wherein in order to perform the technique (b) the processing system is further programmed to:

locate the silent portion; and determine a segment of the silent portion that least correlates with a last time-expanded portion of the voice message.

11. The portable subscriber unit of claim 8, wherein in order to perform the technique (b) the processing system is further programmed to:

locate the silent portion; and determine a segment of the silent portion that exhibits a correlation with a last time-expanded portion of the voice message, the correlation being less than a predetermined amount.

12. The portable subscriber unit of claim 8, wherein in order to perform the technique (c) the processing system is further programmed to:

expand the dynamic range of the voice message after reception by an amount equal to a largest amount of compression of the dynamic range allowable for transmission.

13. The portable subscriber unit of claim 8, wherein in order to time expand the voice message the processing system is further programmed to apply an overlap-add speech expansion technique.

* * * * *